US010510236B2

(12) United States Patent
Stibich et al.

(10) Patent No.: US 10,510,236 B2
(45) **Date of Patent: *Dec. 17, 2019**

(54) SMOKE DETECTORS WITH LIGHT SHIELDS AND ALARM SYSTEMS INCLUDING SUCH

(71) Applicant: Xenex Disinfection Services, LLC., San Antonio, TX (US)

(72) Inventors: Mark A. Stibich, Santa Fe, NM (US); Sarah E. Simmons, San Antonio, TX (US); Edward C. Guerrero, Jr., San Antonio, TX (US); Paul P. Froutan, Katy, TX (US); Nicholas Whitelonis, San Antonio, TX (US); Joseph Taber, San Antonio, TX (US)

(73) Assignee: Xenex Disinfection Services, LLC., San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/377,506

(22) Filed: Apr. 8, 2019

(65) Prior Publication Data

US 2019/0236921 A1 Aug. 1, 2019

Related U.S. Application Data

(63) Continuation of application No. 16/118,690, filed on Aug. 31, 2018, now Pat. No. 10,282,956, which is a (Continued)

(51) Int. Cl.

| | |
|---|---|
| ***G08B 17/113*** | (2006.01) |
| ***G08B 17/11*** | (2006.01) |
| ***G08B 17/107*** | (2006.01) |

(52) U.S. Cl.

CPC ..... *G08B 17/113* (2013.01); *G08B 17/107* (2013.01); *G08B 17/11* (2013.01)

(58) Field of Classification Search

CPC ..... A61B 1/00; G06F 2101/00

See application file for complete search history.

(56) References Cited

U.S. PATENT DOCUMENTS

| | | | |
|---|---|---|---|
| 4,043,776 | A | 8/1977 | Orel |
| 4,168,438 | A | 9/1979 | Morisue |

(Continued)

FOREIGN PATENT DOCUMENTS

| | | |
|---|---|---|
| DE | 102011016275 | 7/2012 |
| DE | 202013003464 | 6/2013 |

(Continued)

OTHER PUBLICATIONS

Xenex Disinfection Services, Notification of Transmittal of the International Preliminary Report on Patentability, dated Jun. 8, 2018, 35 pgs.

(Continued)

*Primary Examiner* — Shirley Lu

(74) *Attorney, Agent, or Firm* — Egan Peterman Enders Huston

(57) ABSTRACT

Smoke detectors and smoke alarms are provided which have one or more light shields configured to block or minimize the transmission of ambient light to their light receivers. Light shield configurations for facilitating such functionality are provided as well. The shield/s include a material which attenuates a majority amount of light within a particular range of light that a light source of the smoke detector may be configured to only emit and/or the range of light the light receiver may configured to only convert to photocurrent. In some cases, the shield/s surrounds the light source and/or the light receiver arranged external to an interior chamber of the smoke detector. In some cases, the shield/s may at least partially span a connection side of an external housing of the smoke detector. Alternatively, the shield may be arranged in (Continued)

a space between the interior chamber and the connection side of the housing.

24 Claims, 4 Drawing Sheets

Related U.S. Application Data continuation of application No. PCT/US2017/020871, filed on Mar. 6, 2017.

(60) Provisional application No. 62/303,533, filed on Mar. 4, 2016.

(56) References Cited

U.S. PATENT DOCUMENTS

| | | | | |
|---|---|---|---|---|
| 4,177,045 | A | 12/1979 | Orel | |
| 4,333,195 | A | 6/1982 | Lichti | |
| 4,462,244 | A | 7/1984 | Lee | |
| 4,803,335 | A | 2/1989 | Steen et al. | |
| 4,849,862 | A | 7/1989 | Diskin et al. | |
| 5,234,428 | A | 8/1993 | Kaufman | |
| 5,296,779 | A | 3/1994 | Muzeroll | |
| 5,340,346 | A | 8/1994 | Muzeroll | |
| 5,363,976 | A | 11/1994 | Kapka | |
| 5,372,477 | A | 12/1994 | Cole | |
| 5,440,145 | A | 8/1995 | Cole | |
| 5,670,946 | A | 9/1997 | Ellwood et al. | |
| 6,518,574 | B1 | 2/2003 | Castleman | |
| 9,696,026 | B1 | 7/2017 | Hardgrave | |
| 10,282,956 | B2 | 5/2019 | Stibich et al. | |
| 2001/0037804 | A1 | 11/2001 | Waters et al. | |
| 2001/0038338 | A1* | 11/2001 | Kadwell | G08B 17/107 340/630 |
| 2004/0217608 | A1 | 11/2004 | Kelly | |
| 2005/0134468 | A1 | 6/2005 | Thomas et al. | |
| 2005/0202395 | A1 | 9/2005 | Edrich et al. | |
| 2006/0261967 | A1 | 11/2006 | Marman et al. | |
| 2008/0012715 | A1 | 1/2008 | Montgomery | |
| 2008/0087492 | A1 | 4/2008 | Cox et al. | |
| 2010/0073926 | A1 | 3/2010 | Kudoh et al. | |
| 2013/0326244 | A1* | 12/2013 | Koyama | G06F 1/26 713/300 |
| 2018/0322753 | A1 | 11/2018 | Stibich et al. | |

FOREIGN PATENT DOCUMENTS

| | | |
|---|---|---|
| DE | 202013005999 | 9/2013 |
| GB | 2464269 | 4/2010 |
| JP | 5962997 | 4/1984 |
| JP | 2000268268 | 9/2000 |
| JP | 2012128777 | 7/2012 |
| WO | 0159737 | 8/2001 |
| WO | 2017127438 | 7/2017 |

OTHER PUBLICATIONS

Xenex Disinfection Services, Written Opinion of the International Preliminary Examining Authority, dated Feb. 6, 2018, 15 pgs.

Xenex Disinfection Services, Notification of Transmittal of the International Search Report and the Written Opinion of the International Searching Authority, dated Jun. 8, 2017, 21 pgs.

European Patent Office, Communication for PCT Patent Application PCT/US2017/020871 dated Jun. 7, 2018, 4 pages.

Australian Government IP Australia, Examination Report for Australian Patent Application 2017228427 dated Oct. 17, 2018, 2 pages.

European Patent Office, Despatch for Information for European Patent Application No. 17711521.9 dated Sep. 6, 2019, 2 pages.

* cited by examiner

SMOKE DETECTORS WITH LIGHT SHIELDS AND ALARM SYSTEMS INCLUDING SUCH

PRIORITY CLAIM

This application is a continuation of pending U.S. patent application Ser. No. 16/118,690 filed Aug. 31, 2018, which is a continuation of International Patent Application No. PCT/US2017/020871 filed Mar. 6, 2017, which designates the United States and claims priority to U.S. Provisional Patent Application No. 62/303,533 filed Mar. 4, 2016.

BACKGROUND OF THE INVENTION

1. Field of the Invention

This invention generally relates to smoke detectors and smoke alarms and, more particularly, light shields for such.

2. Description of the Related Art

The following descriptions and examples are not admitted to be prior art by virtue of their inclusion within this section.

Photoelectric smoke detectors use a light source and a light receiver to detect whether or not smoke is present in its ambient. Smoke is determined to be present when a change in the amount of light received at the light receiver exceeds a pre-determined value. Upon the smoke detector determining smoke is present, a fire alarm is tripped. Some smoke detectors, referred to as spot type smoke detectors, have its light source and light receiver within the detector for a confined location at which to detect smoke. Spot type smoke detectors are commonly used in rooms of relatively smaller size, such as rooms typically found in a house, office building or hospital. The light source is generally an infrared light source, an ultraviolet light source or a visible light source. In some cases, a light receiver of a spot type smoke detector may not be shielded from light of the room in which the smoke detector is arranged and, thus, infrared light, ultraviolet light, relatively large changes of visible light, or particularly high intensities of visible light (such as on the order of 1000 lux or more) from external sources in the room may cause the smoke detector to trigger a false fire alarm. Examples of devices and systems which may constitute such external sources of infrared light, ultraviolet light and/or visible light may include but are not limited to germicidal light disinfection systems, operating room lights, phototherapy systems, and remote controls for electronic devices.

Accordingly, it would be beneficial to develop spot type smoke detectors and shields that block light receivers from light generated in the ambient of a room in which the smoke detector is arranged.

SUMMARY OF THE INVENTION

The following description of various embodiments of apparatuses is not to be construed in any way as limiting the subject matter of the appended claims.

Smoke detectors and smoke alarms are provided which include a light shield that is configured to block or minimize the transmission of ambient light to their electro-optical light receivers. Light shield configurations for facilitating such functionality are provided as well.

The smoke detectors as well as the smoke detectors of the smoke alarms include an interior chamber, a light source arranged within the smoke detector to emit light into the interior chamber and an electro-optical light receiver arranged within the smoke detector to receive direct and/or indirect light from the light source. In some cases, the electro-optical light receiver is configured to only convert a particular range of light to photocurrent. In additional or alternative embodiments, the light source may be configured to only emit light in the particular range of light. In any case, the smoke detectors include an external housing encompassing the interior chamber, the light source and the electro-optical light receiver. Moreover, the smoke detectors include a shield distinct from the external housing that includes a material which attenuates a majority amount of light within the particular range of light that the light source may be configured to only emit and/or the range of light the electro-optical light receiver may configured to only convert to photocurrent. In some cases, at least one of the light source and the electro-optical light receiver is arranged external to the interior chamber and the shield at least partially surrounds the light source or the electro-optical light receiver that is arranged external to the interior chamber. In additional or alternative embodiments, the shield may at least partially span a connection side of the external housing. In yet other cases, the shield may be arranged interior to the external housing in a space between the interior chamber and a connection side of the external housing.

An embodiment of a smoke detector light shield includes a contiguous circumventing band having a diameter between approximately 2 inches and approximately 12 inches and further a base plate coupled to and substantially centered over or under the contiguous circumventing band. The base plate includes notches exposing portions of the contiguous circumventing band.

BRIEF DESCRIPTION OF THE DRAWINGS

Other objects and advantages of the invention will become apparent upon reading the following detailed description and upon reference to the accompanying drawings in which.

Figure 1:
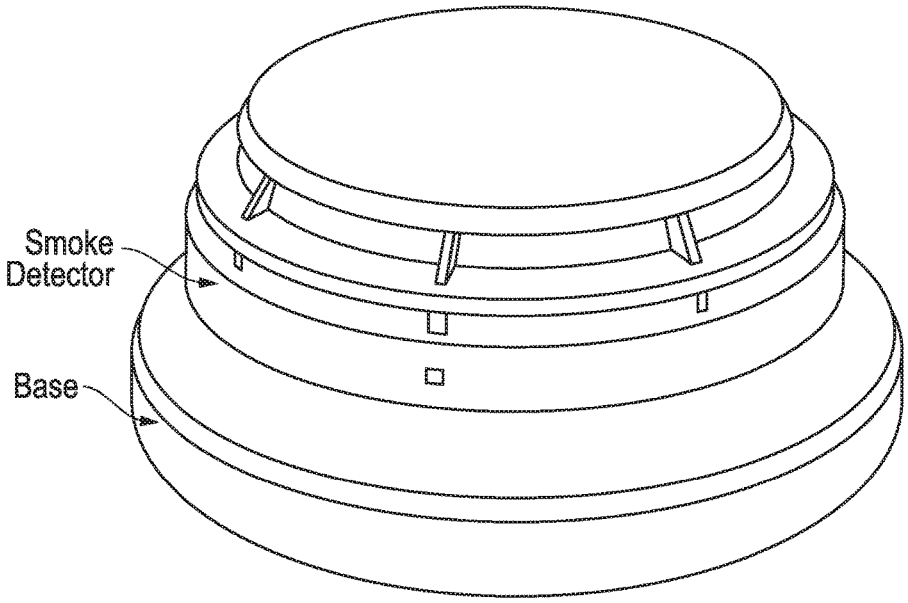
FIG. 1 illustrates a perspective view of an example of a smoke alarm having a smoke detector coupled to a base.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

The smoke detectors and smoke alarms described herein are configured to mitigate false tripping of spot type photoelectric smoke detectors. More specifically, smoke detectors and smoke alarms are provided with light shields that are configured to block ambient light from being transmitted to an electro-optical light receiver of the smoke detector/alarm. Although the smoke detectors and smoke alarms described below are directed to embodiments in which the shields are separate components from the external housing of the smoke detector, the smoke detectors and smoke alarms described herein are not necessarily so limited. In particular, the smoke detector or smoke alarm described herein may alternatively include a light shield as part of the outer housing of the smoke detector and, in some cases, particularly along a connection side of the smoke detector and/or along sidewalls extending therefrom.

As used herein, the "connection side" of a smoke detector refers to a side of the smoke detector that is used to connect to a base alarm or to connect to an electrical box coupled to an alarm system that is common to a plurality of smoke detectors. The term "ambient light", as used herein in, refers to light generated in a room exterior to the smoke detector. Ambient light may be any type of light (i.e., light of any spectrum), including but not limited to infrared light, ultraviolet light, and visible light. Examples of devices and systems which may constitute sources of infrared light, ultraviolet light and/or visible light in the ambient of a smoke detector may include but are not limited to germicidal light disinfection systems, operating room lights, phototherapy systems and remote controls for electronic devices. The term "smoke alarm" as used herein refers to a device or system having at least one smoke sensing device, at least one audible sounder and at least one power source or is at least configured for connection to a power supply. Conversely, the term "smoke detector", as used herein, refers to a smoke sensing device. It does not contain an audible alarm or its own power source and, thus, it must be coupled to another device or system comprising such in order to determine and alert the presence of smoke in an ambient. It is noted that a power supply used for smoke alarms may be a battery and/or a mains power supply of a building.

In some cases, a smoke detector is electrically coupled to a base which includes an audible sounder and a power supply. In such embodiments, the smoke detector and the base may together be a single self-contained smoke alarm for detecting and alerting the presence of smoke. An example of such a smoke alarm is illustrated in FIG. 1. In other cases, a smoke detector may be coupled to an alarm system, such as but not limited to a fire control alarm panel, which may be common to a plurality of smoke detectors and/or include a variety of additional functions other than triggering an audible alarm (e.g., activating visual alarms, activating a sprinkler system and/or alerting a fire response team). In some of such cases, the smoke detector may not be individually coupled to a base component having its own audible sounder and power supply. In other embodiments, however, a smoke detector may be coupled to both a base having an audible sounder and/or a power supply and an alarm system which is common to a plurality of smoke detectors and/or includes functions other than triggering an alarm. Thus, the device depicted in FIG. 1 may also represent a smoke alarm integrated within a system connected to a plurality of smoke alarms and/or a system which includes functions other than triggering an alarm. In any case, in embodiments in which a smoke detector is coupled to a main panel to which a plurality of smoke detectors are connected and/or includes functions other than triggering an alarm, the compilation of components may generally be referenced as a smoke alarm system or a fire alarm system.

Each of the smoke detectors described herein include a light source which emits infrared light, ultraviolet light and/or visible light. In addition, each of the smoke detectors described herein include an electro-optical light receiver. As used herein, the term "electro-optical light receiver" refers to a device that converts received light or a change in received light to photocurrent. The smoke detectors further include circuitry for routing the photocurrent from the electro-optical light receiver to electrical connectors disposed along an external housing of the smoke detector. The electrical connectors of the smoke detector are configured for connection with electrical conductors of an alarm (via a base unit containing the alarm or via an electrical box coupled to an alarm panel) and the alarm is configured to trigger its audible sounder upon receiving photocurrent of a predetermined magnitude. For example, a small amount of photocurrent may induce voltage signal/s at the alarm circuitry which indicate no smoke is detected and photocurrent above a set amount may induce voltage signal/s which indicate smoke is detected.

Any type of light source configured to emit infrared light, ultraviolet light and/or visible light may be used in the smoke detectors described herein. Examples of light sources which may be used include but are not limited to light emitting diodes (LEDs), incandescent bulbs and discharge lamps. In some cases, a light source for the smoke detectors described herein may be specifically configured to only emit light in a particular range of light that includes infrared light, ultraviolet light and/or visible light. In some embodiments, the particular range of light may be a single spectrum of light (i.e., infrared light, ultraviolet light or visible light) and, in some cases, may be less than the entire spectrum of light. In some cases, the light source may be configured to emit light having a peak spectral emission. For example, the light source may be a light emitting diode (LED) with a peak spectral emission of about 880 nanometers.

In other embodiments, a light source that emits light of multiple spectrums and/or multiple ranges of light may be used. For example, a light source that emits a combination of infrared light, ultraviolet light or visible light may be included in the smoke detectors described herein. In addition or alternatively, a light source that emits light of other spectrums (i.e., in addition to infrared light, ultraviolet light and/or visible light) may be used in the smoke detectors described herein. It is noted that the configuration of a light source to emit light of a particular range or spectrum of light or multiple ranges or spectrums of light may refer to the characteristics of the lamp or LED used and/or may refer to optics for filtering and/or changing light produced by the lamp or LED. Furthermore, the reference of a light source being configured to only emit light in a particular range of light need not mean the light source necessarily emits light along the entire range of light.

In general, any type of electro-optical light receiver may be used in the smoke detectors described herein. Examples of electro-optical light receivers which may be used include but are not limited to photoelectric devices, photodiodes, phototransistors, photovoltaic devices, and photoconductive devices. It is noted that smoke detectors having a light source and a photo-sensitive receiver to detect whether or not smoke is present in its ambient are generally referred to in the smoke detector industry as "photoelectric smoke detectors" (i.e., as opposed to "ionization smoke detectors" which function by creating and monitoring a flow of ions therein). As a consequence, a photosensitive light receiver of a photoelectric smoke detector may sometimes be generally referred to as a photoelectric receiver despite having a principle operation that is different from the photoelectric effect. For example, a photoelectric smoke detector may include a photodiode, a phototransistor, a photovoltaic device or a photoconductive device as its photosensitive light receiver, but it may be generally referred to as a photoelectric receiver. As such, the terms "photoelectric receiver" and "electro-optical light receiver" may be used interchangeably herein.

In some cases, the electro-optical light receivers of the smoke detectors described herein may be configured to only convert a particular range of light to photocurrent (i.e., a particular range of light including infrared light, ultraviolet light or visible light). In some embodiments, the particular range of light may be a single spectrum of light (i.e., infrared light ultraviolet light or visible light) and, in some cases, may be less than an entire spectrum of light. In other cases, however, electro-optical light receivers of the smoke detectors described herein may be configured to convert light of multiple spectrums and/or multiple ranges to photocurrent. In yet other embodiments, an electro-optical light receiver may not be specific to the range of light it converts to photocurrent. Alternatively stated, in some cases, the electro-optical light receivers of the smoke detectors described herein may be configured to convert all light received. Such embodiments may be particularly applicable when the light source of a smoke detector is configured to emit light of a particular range of light.

Further to having a light source and an electro-optical light receiver, the smoke detectors described herein include an interior chamber as well as an external housing encompassing the interior chamber, the light source, the electro-optical light receiver and associated circuitry. The external housing includes openings along its sidewalls which provide entry into an air path within the smoke detector that extends to the interior chamber. The interior chamber may be referred to as the smoke chamber as it is the location at which the air introduced into the smoke detector is analyzed for particles, indicating the presence of smoke. In some cases, the light source and/or the electro-optical light receiver may be disposed within the interior chamber. In some embodiments, the light source and/or the electro-optical light receiver may be arranged external to the interior chamber. In the example smoke detector described in more detail below in reference to FIG. 2, the light source of the smoke detector is disposed within the smoke chamber and the electro-optical light receiver is disposed out of the chamber, but the reverse arrangement may be employed. In yet other embodiments, both the light source and the electro-optical light receiver may be disposed in the interior chamber or both the light source and the electro-optical light receiver may be disposed outside the interior chamber. In any case, the light source and the photoelectric receiver may be arranged in the smoke detector to detect the presence of smoke in the interior chamber based on either the light scattering principle or the light obstruction principle.

In some cases, the interior chamber may include exterior walls configured to reflect and/or absorb a majority amount of light with a particular range of light, particularly the range of light that the light source may be configured to only emit and/or the range of light the electro-optical light receiver may configured to only convert to photocurrent. Such a feature may advantageously inhibit light generated in the room in which the smoke detector is arranged from entering the interior chamber such that the affect of ambient light on the amount of light in the interior chamber for detecting smoke may be minimized. In addition, such a feature may be advantageous when an infrared light source is arranged in the interior chamber. In particular, the interior chamber having exterior walls configured to reflect and/or absorb a majority amount of light in the infrared spectrum or a portion thereof may prevent light emitted from the infrared light source in the smoke detector from interfering with infrared-based operations in the room in which the smoke detector is arranged (e.g., remote control of a television in the room). In some cases, the interior walls of the interior chamber may be configured to reflect light emitted from the light source specifically to the electro-optical light receiver. For example, the interior walls of the interior chamber may include materials and/or be shaped to reflect light to the electro-optical light receiver. In addition or alternatively, the interior chamber may include optics for inducing light reflection to the electro-optical light receiver. In any case, the reflected light may advantageously provide a continuous amount of photocurrent to send to an attached alarm. In some embodiments, it may be advantageous to have continuous photocurrent transmitted to alarm circuitry to insure reliable operation of the alarm.

As noted above, the light source and the electro-optical light receiver of the smoke detectors disclosed herein may be independently disposed within or outside of the interior chamber. In cases in which at least one of the light source and the electro-optical light receiver are disposed outside of the interior chamber, the interior chamber must be configured for the transmission of light to or from the outside component. In general, the confines of the interior chamber extend along the side of the smoke detector facing the floor of the room (when operationally mounted in a room) and further extend along the sidewalls of the smoke detector. Either or both of such portions of the interior chamber generally include openings for the transmission of air and smoke into the interior chamber from the smoke inlets of the external housing of the smoke detector. The interior chamber is further bounded by a wall that is in general alignment with a connection side of the smoke detector, but there is a vertical gap between that wall of the interior chamber and the connection side of the smoke detector to accommodate components not disposed in the interior chamber, such as but not limited to a printed circuit board, the light source and/or the electro-optical light receiver. In embodiments in which at least one of the light source and the electro-optical light receiver are disposed in the vertical gap, the wall of the interior chamber adjacent the vertical gap generally includes openings for the transmission of light to or from the light source or the electro-optical light receiver disposed outside the interior chamber.

Although the vertical gap is narrow and close to the connection side of the smoke detector housing, it was discovered during the development of the smoke detectors disclosed herein that if the external housing of a smoke detector allows light in the particular range that the light source may be configured to only emit and/or the particular range of light the electro-optical light receiver may be configured to only convert to photocurrent, ambient room light may be transmitted into the gap and trigger a false detection of smoke. In particular, in embodiments in which the smoke detector has its electro-optical light receiver disposed in the vertical gap outside of the interior chamber, the ambient light transmitted into the gap may be received by the electro-optical light receiver, causing an increase in received light and, thus, possibly causing the electro-optical light receiver to generate photocurrent indicative of smoke detection. Alternatively, in embodiments in which the light source is arranged in the vertical gap but the electro-optical light receiver is arranged in the interior chamber, the ambient light transmitted into the narrow gap between the chamber and connection side of the smoke detector housing may be further transmitted into the interior chamber along with light generated from the light source causing a change of photocurrent at the electro-optical light receiver that may trigger a false smoke alarm. It is contemplated that false alarms could also be triggered when both the light source and electro-optical light receiver are disposed in the interior chamber of the smoke detector if the wall of the interior chamber adjacent the vertical gap has openings. In any case, ambient light transmission may be augmented when a smoke detector is coupled to a smoke alarm base having an external housing which does not block and/or reflect the light of interest used by the smoke detector to determine the presence of smoke. In particular, it is contemplated that ambient light could be transmitted through the external housing of the base and through the connection side of the smoke detector to the vertical gap disposed therein.

To mitigate false alarms, the smoke detectors described herein include one or more shields configured to prevent ambient light from affecting the amount of light received by the electro-optical light receiver. The shields may be arranged exterior or interior to the external housing of the smoke detector. In some cases, a shield may be arranged to at least partially surround a light source or an electro-optical light receiver arranged external to the interior chamber (i.e., at least partially surround a light source or an electro-optical light receiver arranged in a vertical gap between the interior chamber and a connection side of the external housing). In other embodiments, neither a light source nor an electro-optical light receiver may be arranged in the vertical gap, but the smoke detector may include a shield nonetheless surrounding at least a portion of the gap to prevent ambient light from being transmitted into the smoke chamber of the smoke detector. In any case, a shield considered for the smoke detectors described herein may, in some embodiments, surround a majority portion of the vertical gap between the interior chamber and a connection side of the smoke detector. In other embodiments, a smoke detector may have a shield that surrounds a minority portion of the vertical gap. In addition or alternatively, the smoke detectors described herein may include a shield arranged in alignment with the connection side of the external housing. In particular, a shield may, in some embodiments, at least partially span the connection side of the external housing when the shield is arranged external to the housing. Alternatively, a shield may be aligned with the connection side of the external housing when the shield is arranged interior to the housing.

Regardless of the arrangement of the one or more shields, the shield/s include a material which attenuates a majority amount of light in the particular range that the light source of the smoke detector may be configured to only emit and/or the particular range of light the electro-optical light receiver of the smoke detector may be configured to only convert to photocurrent. Example materials for the shield/s when it is desired to block an electro-optical light receiver from ambient infrared light may include but are not limited to black neoprene rubber, polypropylene, polyphenylene ether (such as but not limited to a modified polyphenylene ether/olefin resin blend (e.g., a Noryl™ resin)), poly(methyl methacrylate) (aka, Plexiglas™) having a thickness greater than about 0.118 inch, biaxially-oriented polyethylene terephthalate (aka, Mylar™), and various metals or metalized materials (e.g., gold, aluminum, etc.). Example materials for the shield/s when it is desired to block an electro-optical light receiver from ambient ultraviolet light may include but are not limited to polypropylene, poly(methyl methacrylate) (aka, Plexiglas™), polytetra-fluoroethylene (PTFE) (aka, Teflon™), biaxially-oriented polyethylene terephthalate (aka, Mylar™), polycarbonate, wood, silicone, and various metals or metalized materials. Furthermore, any of the example materials listed above to attenuate infrared or ultraviolet light may be used for the shield/s when it is desired to block an electro-optical light receiver from ambient visible light, but other materials for attenuating visible light may be used.

Figure 2:
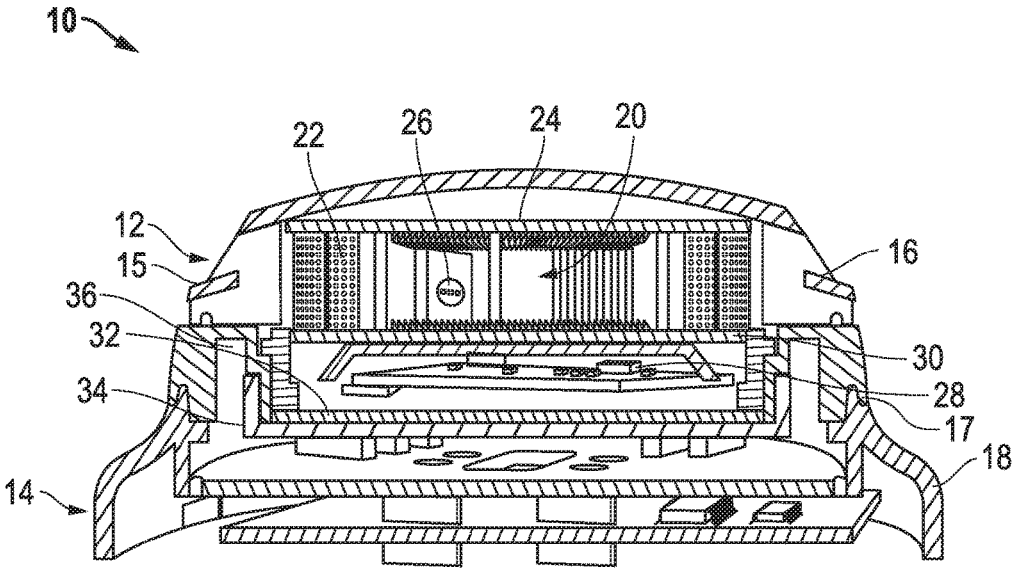
FIG. 2 is a cross-sectional view drawing of the smoke alarm depicted in FIG. 1.

Turning to the drawings, FIG. 2 illustrates an example cross-section view of smoke alarm 10 of FIG. 1, depicting an example of the interiors of smoke detector 12 and base alarm 14. In general, the connection between smoke detector 12 and base alarm 14 is via an interlock coupling 17 between their respective housings 16 and 18 and through their respective electrical connectors. As shown in FIG. 2, smoke detector 12 includes interior chamber 20, the boundaries of which are defined by perforated sidewalls 22, bottom 30 and cap 24. Perforated sidewalls 22 allow air to flow into and out of interior chamber 20 and to and from openings 15 along the sidewalls of housing 12. Light source 26 is disposed in interior chamber 20 and may include any of the light sources described above for the smoke detectors described herein. In particular, light source 26 may be a light source which emits infrared light, ultraviolet light and/or visible light. Electro-optical light receiver 28 is disposed below interior chamber 20, particularly below bottom 30 of interior chamber 20 which has holes for the transmission of light from light source 26 to electro-optical light receiver 28. Although not shown, smoke detector 12 includes circuitry for routing photocurrent from electro-optical light receiver 28 to electrical connectors disposed along connection side 32 of housing 16. In some cases, the exterior surfaces of interior chamber 20 (i.e., exterior surfaces of perforated walls 22, cap 24 and/or bottom 30) may be made of a material configured to reflect and/or absorb a majority amount of light within a particular range of light, particularly the range of light that light source 26 may be configured to only emit and/or the range of light electro-optical light receiver 28 may configured to only convert to photocurrent.

Although not necessarily so restricted, light source 26 and electro-optical light receiver 28 in the example depicted in FIG. 2 are arranged for detection of smoke based on the light scattering principle. More specifically, electro-optical light receiver 28 is arranged to receive light at angle/s relative to horizontal plane of the smoke detector that are different that the primary direction of light emitted from the light source. In other embodiments, however, the light source and the electro-optical light receiver of the smoke detectors disclosed herein may be arranged to detect the presence of smoke based on the light obstruction principle.

As generally described above for the smoke detectors disclosed herein, light source 26 may, in some embodiments, be configured to only emit light in a particular range of light that includes infrared light, ultraviolet light and/or visible light. In addition or alternatively, electro-optical light receiver 28 may be configured to only convert a particular range of light to photocurrent. In any case, to prevent exposure of electro-optical light receiver 28 to ambient light in the particular light range (particularly through housing 16 and housing 18 since they may be made of material/s which are transparent to such light), smoke detector 12 includes shield 34 attached to connection side 32 of housing 16. Shield 34 is made of a material which attenuates a majority amount of light in the particular light range. Examples materials are described above and are not reiterated for the sake of brevity.

Figure 3:
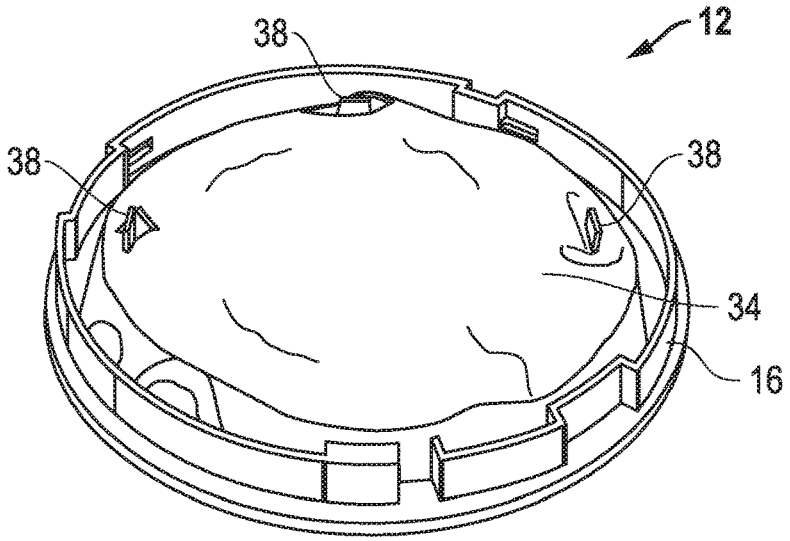
FIG. 3 illustrates a bottom perspective view of the smoke detector depicted in FIG. 2.
Figure 4:
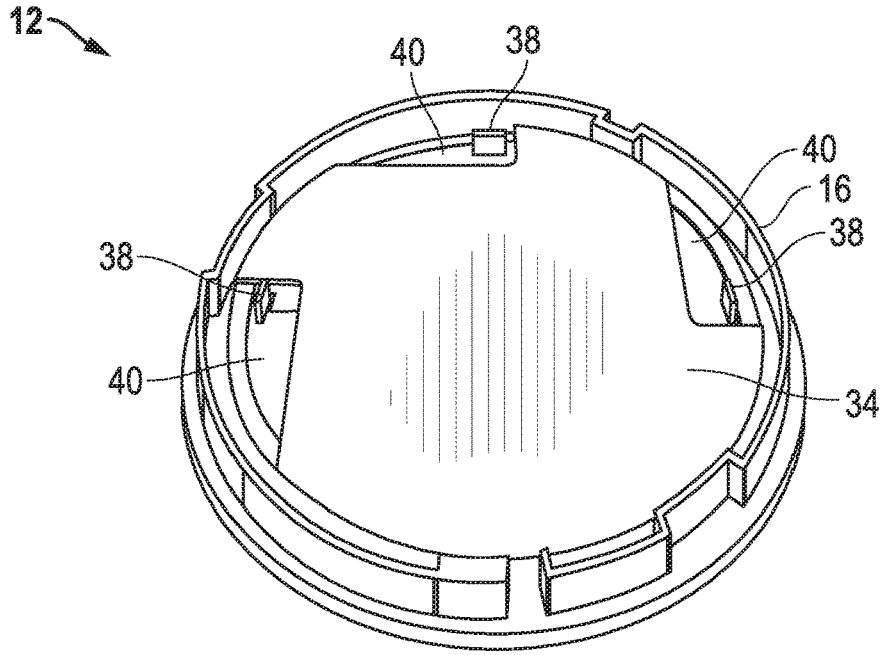
FIG. 4 illustrates a bottom perspective view of the smoke detector depicted in FIG. 2 in an alternative embodiment.

Examples configurations of shield 34 are depicted in FIGS. 3 and 4. In particular, FIG. 3 illustrates shield 34 as a supple material, such as neoprene rubber, fitted around the connection side of housing 16. As shown, shield 34 extends across the connection side of housing 16 as well as within and around ravine 36 of housing 16 (shown in FIG. 2). In addition, shield 34 includes holes which electrical connectors 38 extend through. Electrical connectors 38 are attached to connection side 32 of smoke detector 12. Although shield 34 is shown in FIG. 2 as extending into only a portion of ravine 36 along housing 16, it may alternatively extend to the end of ravine 36. In any case, as shown in FIG. 2, ravine 36 is aligned with the gap between bottom 30 of interior chamber 20 and connection side 32 of external housing 16. Thus, by shield 34 being within ravine 36, shield 34 surrounds electro-optical light receiver 28 disposed exterior to housing 16 in addition to spanning connection side 32 of housing 16. In addition, by shield 34 being within ravine 36, shield 34 surrounds a majority portion of the space between bottom 30 of interior chamber 20 and connection side 32 of external housing 16.

An alternative configuration of shield 34 is shown in FIG. 4. In particular, FIG. 4 illustrates shield 34 having a rigid plate extending across a majority portion of the connection side of housing 16. An example material for the rigid plate may be a thermoplastic polymer, such as polypropylene, but other materials may be used. Shield 34 in such an embodiment includes notches 40 exposing portions of the connection side of housing 16 comprising electrical connectors 38. Similar to the supple cover depicted in FIG. 3, the cover plate depicted in FIG. 4 may include portions which extend into ravine 36 of housing 16. In particular, FIGS. 5 and 6 respectively illustrate interior and exterior perspective views of shield 34 depicted in FIG. 4. As shown, shield 34 includes base plate 42 within notches 40 and further sidewalls 44 for fitting into ravine 36 of housing 16. As with the supple cover depicted in FIG. 3, sidewalls 44 may extend partially or fully into ravine 36.

Figure 5:
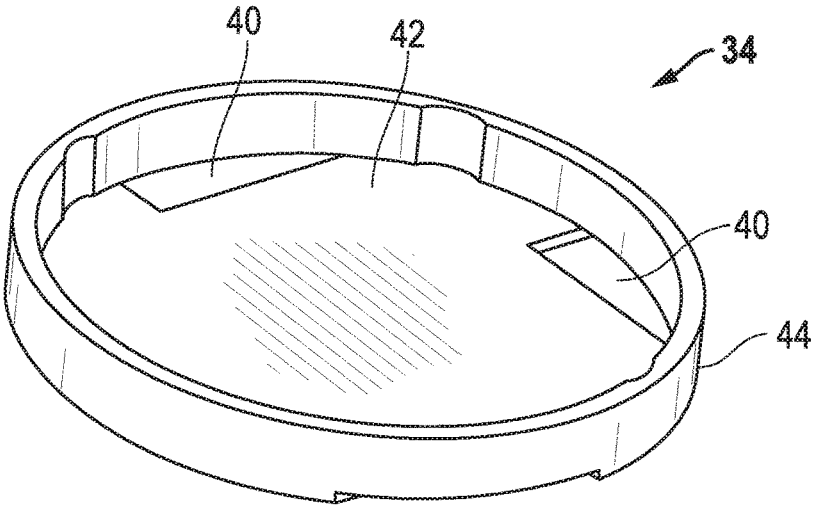
FIG. 5 illustrates an interior perspective view of the shield depicted in FIG. 4.
Figure 6:
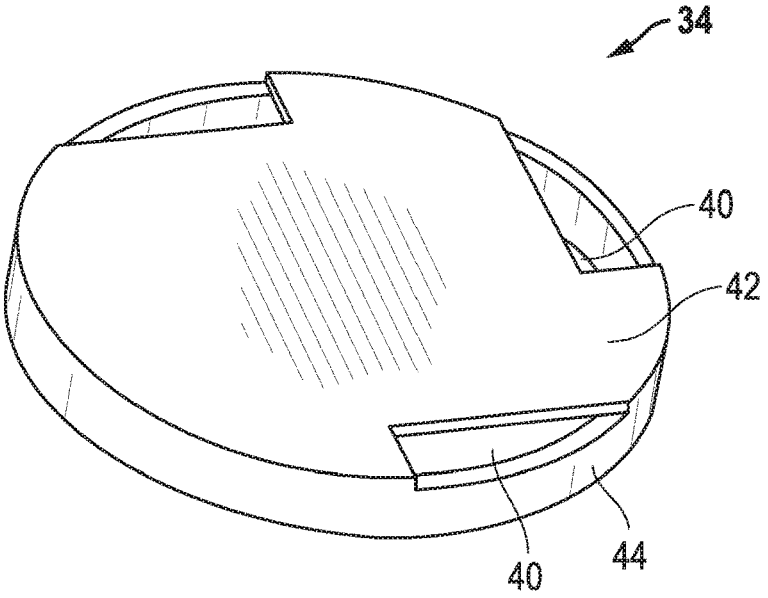
FIG. 6 illustrates an exterior perspective view of the shield depicted in FIG. 4.

In general, sidewalls 44 of shield 34 for the embodiment of FIG. 4 constitute a contiguous circumventing band. In some cases, the contiguous circumventing band may be circular as shown in FIGS. 5 and 6. Other shapes, however, may be considered. For example, depending on the design of the smoke detector which the light shield will be used on, sidewalls 44 may be in the shape of a square, a rectangle, a triangle or an oval. Furthermore, the size of the continuous circumventing band may be dependent on the design of the smoke detector which the light shield will be used on. An example diameter range for the circumventing band may be between approximately 2 inches and approximately 12 inches and, more specifically, between approximately 3 inches and approximately 4 inches, but circumventing bands having smaller or larger diameters may be considered.

In any case, as shown in FIGS. 5 and 6, shield 34 includes base plate 42 coupled to and substantially centered over or under the contiguous circumventing band. The phrase "substantially centered" generally refers to the midpoint of base plate 42 being arranged less than approximately 0.25 inches away from a longitudinal axis around which sidewalls 44 is centered. In some embodiments, the periphery of base plate 42 may not extend beyond the periphery of sidewalls 44. In other cases, however, the periphery of base plate 42 may extend beyond the periphery of sidewalls 44. As noted above, base plate 42 includes notches 40 between portions of the base plate that are coupled to the contiguous circumventing band constituting sidewalls 44. As shown in FIGS. 5 and 6, base plate 42 may have three of such notches in some cases. However, a base plate may include fewer or more notches. In some embodiments, notches 40 may be arranged such that portions of the notches are approximately 90 degrees apart from each other such as shown in FIGS. 3 and 6. In particular, FIGS. 3 and 6 illustrate portions of notches 40 accommodating electrical connectors 38 approximately 90 degrees apart to match the arrangement of the electrical connectors 38 across connection side 32. In some cases, notches 40 of base plate 42 may be sized such that edges of the notches are spaced apart by approximately 45 degrees such as shown in FIGS. 3 and 6. Other degrees of spacing, however, may be considered. In any case, the notches may extend inward from sidewalls 44 by less than approximately 1.0 inch to insure base plate 42 is of sufficient size to cover a majority portion, and in some cases, approximately 90% of the area bordered by sidewalls 44. Furthermore, the shape of notches 40 may differ from those depicted in FIGS. 3, 5 and 6.

It is noted that in some embodiments alternative to either of the configurations depicted in FIGS. 3 and 4, shield 34 may not include the portion spanning connection side 32 or may not include the portion within ravine 36. Thus, the configurations of external light shields considered for the smoke detectors described herein are not necessarily restricted to the embodiments illustrated in FIGS. 3 and 4. Furthermore, although the light shields shown in FIGS. 3-6 are single composite shields, the light shields may alternatively be comprised of multiple parts. The multiple parts may be connected or not connected and may be spaced apart from each other or not spaced apart from each other. In any of such cases, the multiple parts may be respectively referenced as distinct light shields and, thus, the smoke detectors described herein may include multiple light shields for preventing exposure of their electro-optical light receivers to ambient light in a particular light range.

Figure 7:
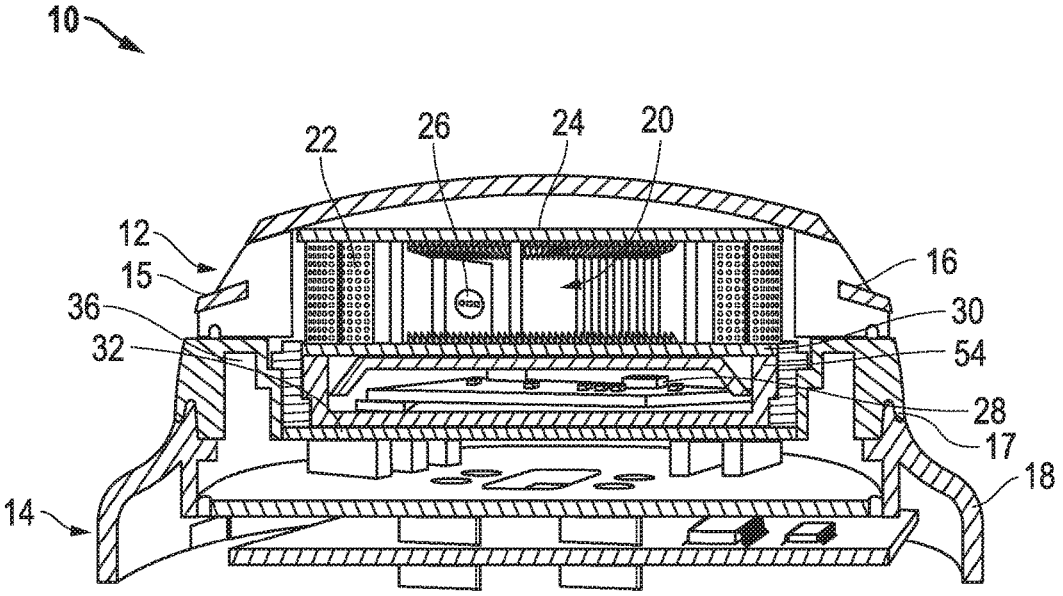
FIG. 7 is a cross-sectional view drawing of the smoke alarm depicted in FIG. 1 having a light shield disposed interior to the smoke detector.
Figure 8:
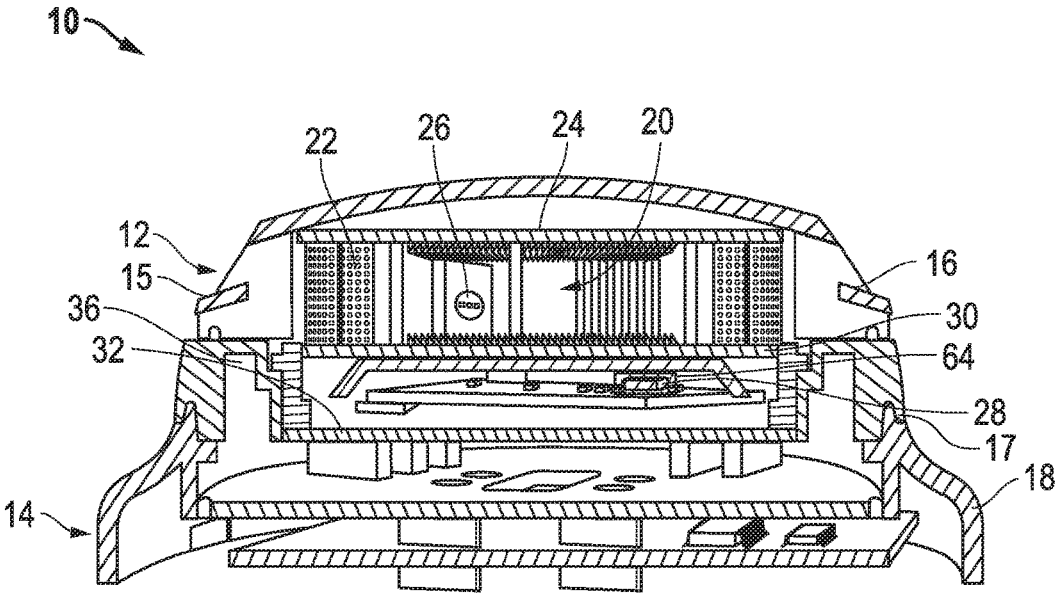
FIG. 8 is a cross-sectional view drawing of the smoke alarm depicted in FIG. 1 having a light shield of a different configuration disposed interior to the smoke detector.

As noted above, the light shields considered herein may, in some embodiments, be arranged interior to the smoke detector. Examples of smoke detectors having internal light shields for preventing exposure of their electro-optical light receivers to ambient light in a particular light range (particularly light in the particular range that the light source may be configured to only emit and/or the particular range of light the electro-optical light receiver may be configured to only convert to photocurrent) are shown in FIGS. 7 and 8. In particular, FIGS. 7 and 8 illustrate cross-section views of smoke alarm 10 of FIG. 1 having light shields arranged in the space between connection side 32 of external housing 16 and bottom 30 of interior chamber 20 as an alternative to having a light shield arranged exterior to housing 16 as depicted in FIG. 2. Features depicted in FIGS. 7 and 8 with the same configurations as described in reference to FIG. 2 are denoted with the same reference numbers (e.g., interior chamber 20, connection side 32, ravine 36, etc.) and the descriptions of such features are not reiterated for the sake of brevity.

As shown in FIG. 7, smoke alarm 10 may, in some embodiments, include light shield 54 attached to the interior side of connection side 32 of housing 16 and further extend along the interior sidewalls of housing 16 within the gap between connection side 32 and bottom 30 of interior chamber 20. In alternative case, shield 54 may be spaced apart from the interior side of connection side 32 and/or spaced apart the sidewalls of housing 16 extending therefrom. In either case, the portions of shield 54 in alignment the sidewalls of housing 16 may extend partially or fully up to bottom 30 of interior chamber 20. In either configuration, the portions of shield 54 in alignment the sidewalls of housing 16 serve to surround electro-optical light receiver 28 disposed exterior to housing 16. In addition, the portions of shield 54 in alignment the sidewalls of housing 16 serve to surround a majority portion of the space between bottom 30 of interior chamber 20 and connection side 32 of external housing 16. In yet alternative embodiments, shield 54 may not include portions in alignment the sidewalls of housing 16 or may not portions of at least partially spanning the interior side of connection side 32.

In any case, as with shield 34, shield 54 is made of a material which attenuates a majority amount of light in the particular range that light source 26 may be configured to only emit and/or the particular range of light that electro-optical light receiver 28 may be configured to only convert to photocurrent. Examples materials are described above and are not reiterated for the sake of brevity. Furthermore, in embodiments in which shield 54 spans at least partially across the interior side of connection side 32, shield 54 may include holes which electrical connectors and/or circuitry may extend through to the electrical connectors disposed on the exterior side of connection side 32. Furthermore, shield 54 may be a single composite component or may include multiple components.

Turning to FIG. 8, an alternative configuration of smoke alarm 10 of FIG. 1 is shown having light shield 64 specifically surrounding electro-optical light receiver 28. It is noted that electro-optical light receiver 28 is shown in FIG. 8 behind shield 64 to emphasize the shield surrounds the receiver, but such a depiction need not indicate that the shield is necessarily transparent to visible light. In alternative embodiments in which light source 26 is disposed outside of interior chamber 20 and electro-optical light receiver 28 is disposed inside interior chamber 20, shield 64 may surround light source 26. In any case, the height of shield 64, particularly the portion extending to an elevation above electro-optical light receiver 28 (or light source 26), may be sufficient to substantially block ambient light from accessing the receiver. In some embodiments, in order to provide such functionality, shield 64 may extend up to one or more openings in bottom 30 of interior chamber 20 such that shield 64 may provide a light tunnel to electro-optical light receiver 28. In some of such cases, the upper surface of shield 64 may be in contact with bottom 30 of interior chamber 20. In other embodiments, the upper surface of shield 64 may be spaced below bottom 30 by less than a few millimeters. In yet other cases, the upper surface of shield 64 may extend up to interior chamber 20 through an opening in bottom 30. Regardless of the height of shield 64, the width of shield 64 may vary depending on the design specifications of the smoke detector, particularly the arrangement of components in the space between bottom 30 of interior chamber 20 and connection side 32 of external housing 16. In general, however, shield 64 may serve to surround a minority portion of the space between bottom 30 of interior chamber 20 and connection side 32 of external housing 16.

In any case, as with shields 34 and 54, shield 64 is made of a material which attenuates a majority amount of light in the particular range that light source 26 may be configured to only emit and/or the particular range of light that electro-optical light receiver 28 may be configured to only convert to photocurrent. Examples materials are described above and are not reiterated for the sake of brevity. Furthermore, shield 64 may be a single composite component or may include multiple components.

It is noted that the smoke detectors, smoke alarms (including single standalone smoke alarms as well as smoke alarm systems) and light shields described herein should not be limited to the drawings. In particular, any of the smoke detectors, smoke alarms and light shields depicted in FIGS. 1-8 may include additional components not shown in the drawings. In addition, any of the smoke detectors, smoke alarms and light shields depicted in FIGS. 1-8 may include a rearrangement of parts not shown in the drawings which accomplishes the same objective described in reference to FIGS. 1-8. Furthermore, size and shape of the components of the devices shown in FIGS. 1-8 as well as the size and shapes of the smoke detectors, smoke alarms and light shields themselves are exemplary.

It will be appreciated to those skilled in the art having the benefit of this disclosure that this invention is believed to provide smoke detectors having one or more light shields that are configured to block or minimize the transmission of ambient light to their electro-optical light receivers as well as smoke alarms comprising such smoke detectors and light shields for facilitating such functionality. Further modifications and alternative embodiments of various aspects of the invention will be apparent to those skilled in the art in view of this description. For example, the materials of the light shields disclosed herein may be alternatively incorporated into the external housing of the smoke detectors, particularly along a connection side of the external housing and/or sidewalls of the external housing extending from the connection side. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number.

What is claimed is:

1. A smoke alarm, comprising:

a smoke detector comprising:

an interior chamber;

a light source arranged within the smoke detector to emit light into the interior chamber;

an electro-optical light receiver arranged within the smoke detector to receive direct and/or indirect light from the light source, wherein at least one of the light source and the electro-optical light receiver is arranged external to the interior chamber, and wherein the electro-optical light receiver is configured to only convert a particular range of light to photocurrent and/or wherein the light source is configured to only emit light in the particular range of light;

an external housing encompassing the interior chamber, the light source and the electro-optical light receiver;

electrical connectors in electrical communication with the electro-optical light receiver, wherein the electrical connectors extend out beyond the external housing; and a shield arranged exterior to the external housing, wherein the shield surrounds a space within the smoke detector between the interior chamber and a connection side of the external housing, wherein the shield further spans at least a portion of the connection side of the external housing, wherein the shield comprises openings which the electrical connectors extend through, wherein the shield at least partially surrounds the light source or the electro-optical light receiver that is arranged external to the interior chamber, and wherein the shield comprises a material which attenuates a majority amount of light within the particular range of light; and a base coupled to the connection side of the smoke detector, wherein the connection side of the smoke detector includes an exterior surface of the external housing comprising the electrical connectors, and wherein the base comprises an audible alarm and a power supply in electrical communication with the electrical connectors.

2. The smoke alarm of claim 1, wherein the shield spans a majority portion of the connection side of the external housing.

3. The smoke alarm of claim 1, wherein the shield is arranged in a groove between a circumferential edge and a base plate of the connection side of the external housing.

4. The smoke alarm of claim 1, wherein the light source is configured to emit infrared light, and wherein the particular spectrum comprises at least a portion of a light spectrum between approximately 700 nm and approximately 1 mm.

5. The smoke alarm of claim 1, wherein the light source is configured to emit ultraviolet light, and wherein the particular spectrum comprises at least a portion of a light spectrum between approximately 10 nm and approximately 400 nm.

6. The smoke alarm of claim 1, wherein the light source is configured to emit visible light, and wherein the particular spectrum comprises at least a portion of a light spectrum between approximately 390 nm and approximately 700 nm.

7. The smoke alarm of claim 1, wherein the external housing comprises a material which passes a majority amount of light within the particular range of light.

8. The smoke alarm of claim 1, wherein the interior chamber comprises exterior walls configured to reflect and/or absorb a majority amount of light within the particular range of light.

9. The smoke alarm of claim 1, wherein the light source is disposed within the interior chamber, and wherein the electro-optical light receiver is disposed outside of the interior chamber.

10. The smoke alarm of claim 1, wherein the shield comprises polypropylene.

11. The smoke alarm of claim 1, wherein the shield comprises polyphenylene ether.

12. The smoke alarm of claim 1, wherein the shield comprises black neoprene rubber.

13. A smoke alarm system, comprising:

an alarm system; and a plurality of smoke detectors coupled to the alarm system, wherein at least one of the plurality of smoke detectors comprises:

an interior chamber;

a light source arranged within the smoke detector to emit light into the interior chamber;

an electro-optical light receiver arranged within the smoke detector to receive direct and/or indirect light from the light source, wherein at least one of the light source and the electro-optical light receiver is arranged external to the interior chamber, and wherein the electro-optical light receiver is configured to only convert a particular range of light to photocurrent and/or wherein the light source is configured to only emit light in the particular range of light;

an external housing encompassing the interior chamber, the light source and the electro-optical light receiver;

electrical connectors in electrical communication with the electro-optical light receiver, wherein the electrical connectors extend out beyond the external housing; and a shield arranged exterior to the external housing, wherein the shield surrounds a space within the smoke detector between the interior chamber and a connection side of the external housing, wherein the shield further spans at least a portion of the connection side of the external housing, wherein the shield comprises openings which the electrical connectors extend through, wherein the shield at least partially surrounds the light source or the electro-optical light receiver that is arranged external to the interior chamber, and wherein the shield comprises a material which attenuates a majority amount of light within the particular range of light.

14. The smoke alarm system of claim 13, wherein the shield spans a majority portion of the connection side of the external housing.

15. The smoke alarm system of claim 13, wherein the shield is arranged in a groove between a circumferential edge and a base plate of the connection side of the external housing.

16. The smoke alarm of system claim 13, wherein the light source is configured to emit infrared light, and wherein the particular spectrum comprises at least a portion of a light spectrum between approximately 700 nm and approximately 1 mm.

17. The smoke alarm system of claim 13, wherein the light source is configured to emit ultraviolet light, and wherein the particular spectrum comprises at least a portion of a light spectrum between approximately 10 nm and approximately 400 nm.

18. The smoke alarm system of claim 13, wherein the light source is configured to emit visible light, and wherein the particular spectrum comprises at least a portion of a light spectrum between approximately 390 nm and approximately 700 nm.

19. The smoke alarm system of claim 13, wherein the external housing comprises a material which passes a majority amount of light within the particular range of light.

20. The smoke alarm system of claim 13, wherein the interior chamber comprises exterior walls configured to reflect and/or absorb a majority amount of light within the particular range of light.

21. The smoke alarm system of claim 13, wherein the light source is disposed within the interior chamber, and wherein the electro-optical light receiver is disposed outside of the interior chamber.

22. The smoke alarm system of claim 13, wherein the shield comprises polypropylene.

23. The smoke alarm system of claim 13, wherein the shield comprises polyphenylene ether.

24. The smoke alarm system of claim 13, wherein the shield comprises black neoprene rubber.

* * * * *